US005176269A

United States Patent [19]

Herman

[11] Patent Number: 5,176,269

[45] Date of Patent: Jan. 5, 1993

[54] DECORATIVE AND AESTHETIC MULTI-PART CLOSURE, CAPS, COVERS AND THE FABRICATION THEREOF

[75] Inventor: Michael Herman, Huntingdon, N.Y.

[73] Assignee: Herman Pearl Button Co., Inc., New York, N.Y.

[21] Appl. No.: 847,679

[22] Filed: Feb. 28, 1992

Related U.S. Application Data

[63] Continuation-in-part of Ser. No. 805,320, Dec. 10, 1991.

[51] Int. Cl.[5] ..... B65D 41/62

[52] U.S. Cl. ..... 215/228; 215/230; 215/277; 215/334; 220/212; 220/255; 220/376

[58] Field of Search ..... 215/228, 230, 263, 274, 215/277, 334; 220/212, 254, 255, 256, 376

[56] References Cited

U.S. PATENT DOCUMENTS

| | | | |
|---|---|---|---|
| 2,079,545 | 5/1937 | Bugh | 215/230 |
| 2,263,472 | 11/1941 | Reichenbach | 215/334 |
| 3,085,709 | 4/1963 | Klein | 215/228 X |
| 3,303,953 | 2/1967 | Frank | 215/228 |
| 3,768,688 | 10/1973 | Linke | 215/228 X |
| 3,856,170 | 12/1974 | Kessler . | |
| 3,896,974 | 7/1975 | McIntosh | 215/228 X |
| 4,194,848 | 3/1980 | Kingsford . | |
| 4,273,248 | 6/1981 | Lehmann | 215/331 |
| 4,440,306 | 4/1984 | Van Buskirk et al. . | |
| 4,487,325 | 12/1984 | Willingham | 215/307 |
| 4,709,825 | 12/1987 | Mumford | 215/318 |
| 4,747,497 | 5/1988 | Holman | 215/230 |
| 4,753,358 | 6/1988 | Virca et al. | 215/230 |
| 4,765,379 | 8/1988 | Szymanski . | |
| 4,812,317 | 3/1989 | Taylor . | |
| 5,025,941 | 6/1991 | Petit | 215/228 |
| 5,088,611 | 2/1992 | Katz | 215/230 |
| 5,092,477 | 3/1992 | Johnson, Jr. et al. | 215/230 |

*Primary Examiner*—Allan N. Shoap
*Assistant Examiner*—Vanessa Caretto
*Attorney, Agent, or Firm*—Richard S. Roberts

[57] ABSTRACT

Rib and groove snap-type action securing elements are formed respectively on closure bases and caps so that a number of different closure caps can be disposed for co-action with a single base to fabricate a number of different closure assemblies. In one embodiment the rib is carried by a depending circumferential wall of the cap for co-action with a circumferential groove formed in the base, while in another embodiment the rib is carried by an upstanding circumferential wall of the base for co-action with a groove disposed peripherally about the cap. In other embodiments a disc-like intermediate cap is disposed between a base and a top cap formed with a surrounding depending wall with a bead along its lower edge for co-action with the lower edge of the base. In yet another embodiment the intermediate member is also formed with a depending circumferential wall terminating in a circumferential bead which co-acts with a lower edge of the base and with a groove on its outer surface that co-acts wth a bead proximate the lower edge of the top cap. In yet another embodiment the cap includes a pair of parallel disposed ribs one for co-action with a disc-like intermediate cap and one for co-action with the base member.

7 Claims, 9 Drawing Sheets

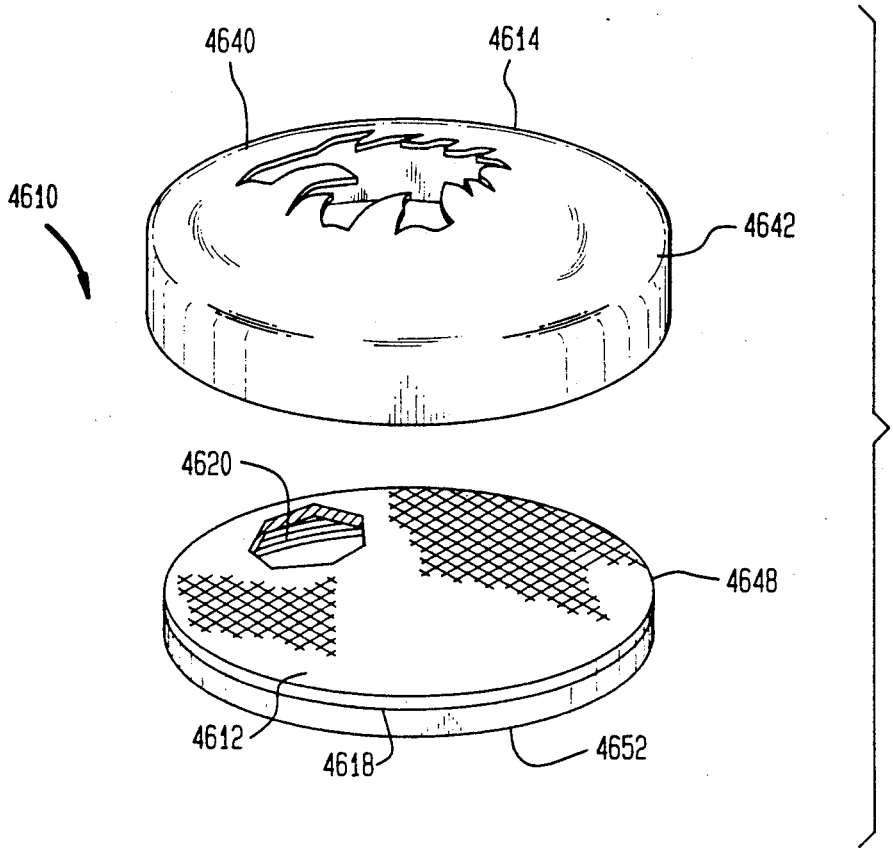
FIG. 19
FIG. 20
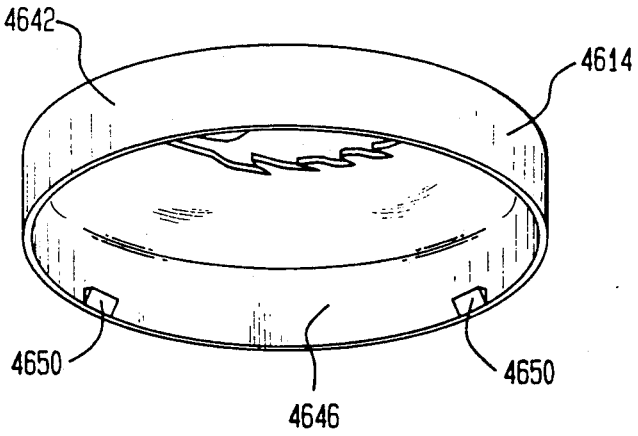
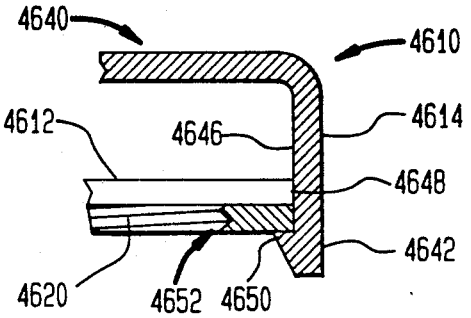
FIG. 21

DECORATIVE AND AESTHETIC MULTI-PART CLOSURE, CAPS, COVERS AND THE FABRICATION THEREOF

CROSS REFERENCE TO RELATED APPLICATION

This application is a continuation-in-part of U.S. patent application Ser. No. 07/805,320 filed Dec. 10, 1991, which is incorporated herein by reference.

BACKGROUND OF THE INVENTION

This invention relates to containers and bottles and more particularly to multi-part closures, caps, covers and the like for containers and bottles and a method of fabrication thereof.

Containers, such as bottles and the like, especially necked bottles which are closed by caps and covers, are functional in size and shape and are selected to accommodate the type of and the amount of the contents to be placed in the container. Some bottle type containers have aesthetically selected shapes, which in many instances act as trademarks, to distinguish one bottle container from another.

A number of such containers, especially bottle containers are provided about their upper periphery, or about bottle necks provided at the bottles's upper periphery, with one or more types of screw threads or screw-like threads to facilitate capping or covering the container. Most such container caps as essentially functional in size, shape and configuration. Sometimes, especially for cosmetics, greater attention is give to the aesthetics of the container bottle and its cover, particularly for such containers which are to be stored in view as on a dressing or make-up table. Such containers and their caps or covers are generally not ornamented or decorated.

In general most container caps or covers, especially ones that are provided with internal threads to facilitate applying the cap or cover to a bottle, are unitary one piece articles which are fabricated from conventional materials such as metals, plastic or glass.

U.S. Pat. No. 3,856,170 shows a typical one piece safety cap for a necked container which does not have an augmentation of its aesthetic appearance. U.S. Pat. No. 4,194,848 on the other hand, describes an internally threaded container cap for a mascara container which has a tapered but otherwise non-ornamented surface.

Certain multi-part container covers or caps are shown in U.S. Pat. No. 3,896,974 and 4,765,379. However, in such arrangements, the multiple parts of the container closures physically separate or are separated one from the other and actually provide two separate covers and not a multi-part cover or cap with the parts physically attached together. In addition, there is no ornamentation or decoration for these containers, caps or closures.

U.S. Pat. No. 4,812,317 shows a functional cover for a corked wine bottle with no aesthetic ornamentation or treatment applied thereto. Similarly, U.S. Pat. No. 4,440,306 also shows a multi-part container closure but wherein the cap parts separate after initial opening of the container. Such a cap is also purely function and without ornamentation or decoration.

SUMMARY OF THE INVENTION

The invention provides a closure assembly comprising:

(a) closure base means including attaching thread means for securing said closure base means to a bottle or the like; and (b) closure cap means for co-action with and mounting to said closure base means; and (c) said closure base means and said closure cap means together carrying said securing means for non-removably securing said closure base means and closure cap means together into a closure assembly, said securing means including securing elements which readily co-act to secure said closure base means and closure cap means together and which substantially prevent separation of said closure base means and said closure cap means.

The invention also provides a method of producing a closure assembly comprising:

(a) providing closure base means including thread means for securing said closure base means to a bottle or the like; and (b) providing closure cap means for co-action with and mounting to said closure base means; and (c) said closure base means and said closure cap means together carrying said securing means for non-removably securing said closure base means and closure cap means together into a assembly, said securing means including securing elements which readily co-act to secure said closure base means and closure cap means together and which prevent separation of said closure base means and said closure cap means; said securing elements comprise one or more raised chevron shaped wedge members positioned about an internal or external perimeter wall of said closure cap means or said closure base means, and oppositely, a plurality of complementary recessed chevron shaped wedge members positioned about an external or internal perimeter wall of said closure base means or said closure cap means which ever does not have the raised chevron members, said raised chevron members and said recessed chevron members being closure capable of a snap-together engagement with one another, which engagement substantially prevents the movement of said closure cap means with respect to said closure base means; and d) snapping together said closure base means and said closure cap means and engaging said complementary recessed and raised chevron members.

It is therefore an object of this invention to provide improved multi-part container closures, caps, covers and the like which are provided with ornamentation and wherein a single base accepts, a number of different closure caps or covers which may be decorative. The decorative members, once secured to the closure base member cannot separate therefrom.

Other objects, features, and advantages of the invention in its details of construction and arrangement of parts will be seen from the above and from the following description of the preferred embodiments when considered with the drawing and from the appended claims.

BRIEF DESCRIPTION OF THE DRAWINGS

In the drawings:

FIG. 19 is an exploded perspective view of still a further closure assembly incorporating the instant invention.

FIG. 20 is a perspective view of the cap or cover for the closure assembly of FIG. 19, looking in from the bottom to better show details thereof.

FIG. 21 is an enlarged sectional view of a portion of the cover for the assembly of FIG. 19 showing one of the latching elements of the closure assembly of FIGS. 19 and 20.

DESCRIPTION OF THE PREFERRED EMBODIMENTS

Figure 1:
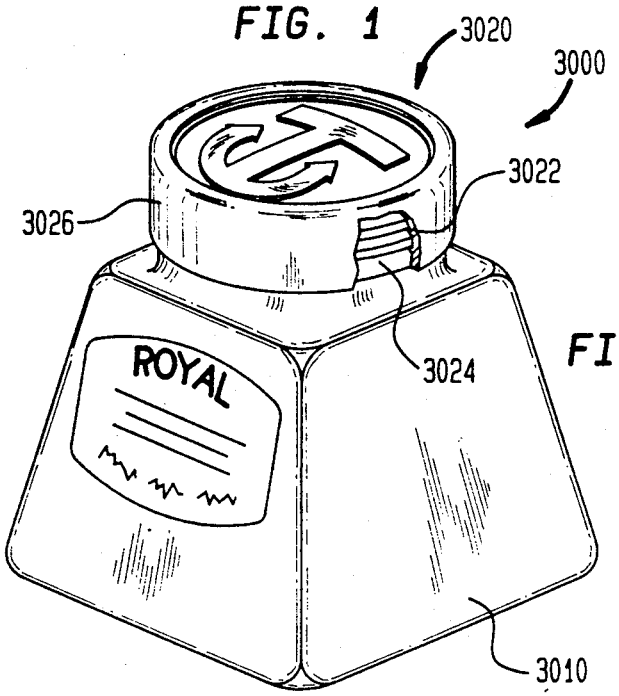
FIG. 1 is a perspective showing of a container in the form of a bottle with a closure assembly incorporating the instant invention.

With reference to FIG. 1 there is generally shown at 3000 a container assembly attached to a bottle 3010 sized and shaped to hold a desired substance such as a cosmetic. A closure 3020 (FIGS. 1-3) is provided for bottle 3010. Closure 3020 includes a set of internal screw threads 3022 (FIG. 1) which are sized, shaped and configured to co-act with external threads 3024 formed about a neck 3026 formed on top of bottle 3010.

While container 3010 is shown as a bottle it should be understood that other forms, sizes and configurations of containers may just as well be used and that such containers may be sized to receive and accommodate the amount, type and characteristics of the intended container contents. As such, reference to a container shall be generic and inclusive and shall include bottles, flasks, and other items in which substances may be placed and which are to be covered by a closure, cap, cover or the like. Similarly, closure 3020 while shown and described with a particular configuration may be of a size and configuration suitable for the container and its purpose or purposes. The use of a closure is intended to include caps, covers, tops and the like and while the closures are described and shown in the various embodiments as including multiple screw threads, single screw threads may serve just as well and other closing arrangements such as snap on closures are also included.

Closure 3020 is, in fact, an assembly including a closure base member 3030 (FIGS. 2, 3 and 5) and a closure cap member 3050.

Figure 3:
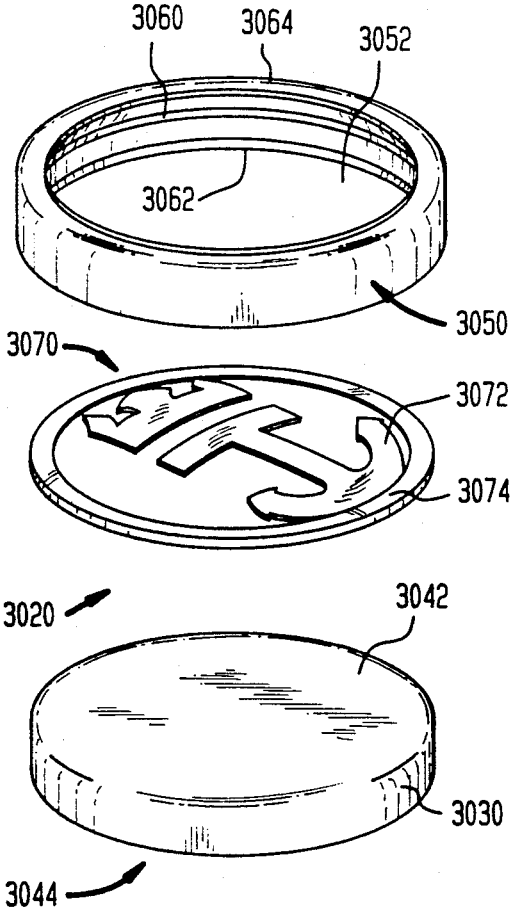
FIG. 3 is a further exploded perspective view of the closure assembly of FIGS. 1 and 2.
Figure 4:
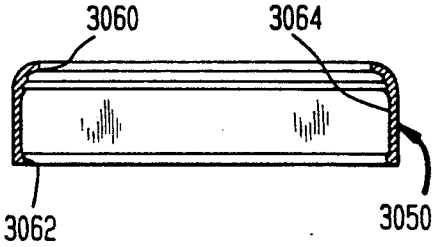
FIG. 4 is a vertical sectional view of the cover portion of the closure assembly of FIGS. 1-3.
Figure 5:
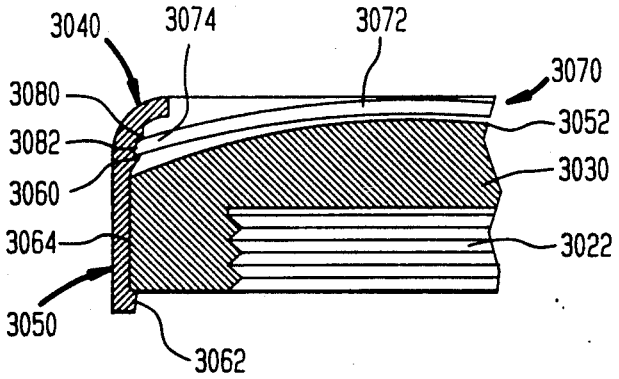
FIG. 5 is a vertical sectional view of a portion of the closure assembly of FIGS. 1-4 enlarged to better show details thereof.

FIGS. 3, 4 and 5 together show further details of closure assembly 3020 and its base or body member 3030 (FIGS. 3 and 5) which is formed of suitable and appropriate material such as metal, plastic or the like and has an upper surface 3042 which may or may not be decorated and a lower surface 3044 within which are provided structure in the form of internal screw threads 3022 for attaching closure 3020 to bottle 3010.

The outer surface 3040 of snap cover 3050 (FIGS. 3-5) is formed cap-like and of suitable metal, plastic or other materials and of a size and configuration to receive within an inside space 3052 provided therewithin and to co-act with base body member 3030. A pair of substantially parallel and spaced latching rings or ribs 3060, 3062 are formed within and extending from an inner surface 3064 of cover 3050. The lower ring or rib 3062 is configured and disposed to co-act with a lower surface of base 3030 to retain base 3030 and cover 3050 positioned one with respect to the other.

Figure 2:
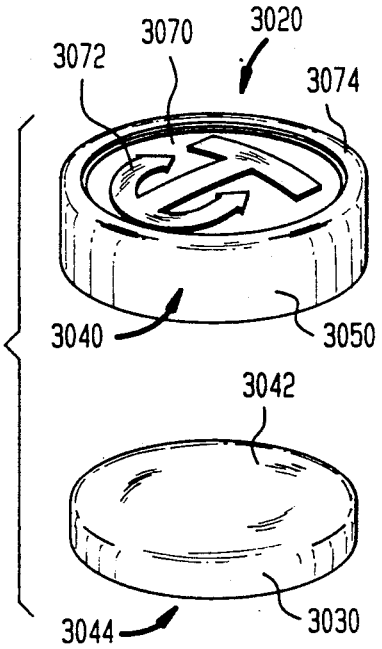
FIG. 2 is a perspective showing of a closure assembly for the container of FIG. 1, partially exploded to better show details thereof.

Optional insert 3070 (FIGS. 3 and 5) is formed of suitable material such as metal, plastic or the like so as to provide a decorative effect when disposed between snap cover 3050 and base 3030 as shown in FIGS. 1 and 2. Insert 3070 may be solid, or cut-out to form a design 3072 (FIG. 3) disposed within a circumferential ring 3074. Insert 3070 is sized and configured to be snapped in place within space 3052 or cover 3050 and to be secured in position by co-action of ring 3074 of insert 3070 with latch ring or rib 3060 as shown in FIG. 5.

The assembly of FIG. 3 shows a base 3030, a cover 3050 and a single insert 3070 which engages the inside of the cap. It is contemplated that one can provide several levels of similar inserts, each partially overlapping one another inside of the over 3050 in a multi-level arrangement.

As shown in FIG. 5, if desired, ring or rib 3060 may be formed to co-act with and be spaced from an upper ridge 3080 to define with rib 3060 a circumferential groove 3082 sized and configured to receive and secure in position circumferential ring 3074 of insert 3070. This construction will permit a pre-assembly of selected inserts 3070 and snap covers 3050 as a sub-assembly for later combination with base 3030.

Latch rings or ribs 3060, 3062 may be formed continuous as described or as discrete and discontinuous spaced members disposed about and extending from inner surface 3064 of snap cover 3050.

Closure assembly 3020 thus permits use of a single base member 3030 with many different inserts 3070 and snap rings 3050 to facilitate the availability of a relatively large variety of closures.

It is an important feature of this invention that the closure cap and closure base members of the assembly be substantially permanently and non-removably attached to one another once they are snapped together. This means that once these part are united, essentially the only way they can be separated again would be to physically break them apart so that they would subsequently be non-usable, i.e. not re-attachable. This is important since if an item readily disassembles, consumers would find it unacceptable. For example, if a closure on a bottle comes apart either in a store, or in use, the customer would find that entire bottle arrangement to be unacceptable. Hence readily detachable closures would be flimsy and not commercially viable. An important feature of this invention is that the closure assemblies must be non-removable once attached. In the preferred embodiment, this non-removable attachment is achieved in the absence of adhesives. In a more preferred embodiment, the closure elements are also non-rotatable with respect to one another and in the most preferred embodiment, the elements are substantially not movable at all with respect to one another.

The above described closure assembly construction thus permits use of a single closure base member with many different cap members and facilitates the availability of a variety of closures to a manufacturer of closures for containers, bottles, etc., which utilize such closures, while at the same time minimizing the number of items in inventory by reducing the number of closure bases for making such closure assemblies.

Figure 6:
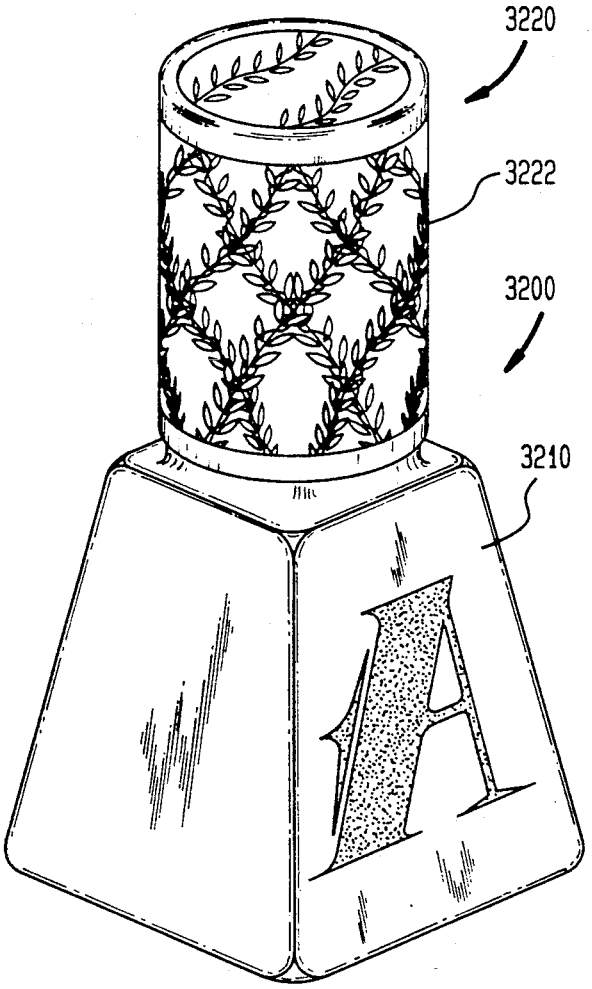
FIG. 6 is a perspective showing of an alternative container in the form of a bottle with an alternative closure assembly incorporating the instant invention.
Figure 7:
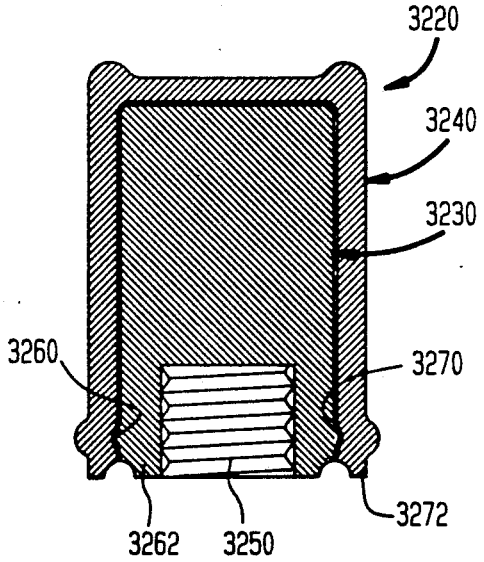
FIG. 7 is a vertical sectional view through the closure assembly of FIG. 6.

FIGS. 6 and 7 show another container 3200, also as a display bottle 3210 closed by a closure 3220 ornamented and decorated at 3222 about its outside surfaces. Closure 3220 like closure 3020 of the embodiment of FIGS. 1–5 includes a closure base member 3230 (FIG. 7) and a closure cap member 3240. The height of closure 3220 is higher than that of closure 3020 of FIGS. 1 and 2 for decorative and aesthetic purposes.

A plurality of internal screw threads 3250 (FIG. 7) are formed within base member 3230 for co-action with external threads )not shown) formed around the neck of container bottle 3210. A rib 3260 extends around the periphery of base member 3230 proximate a lower portion 3262 thereof. Rib 3260 may either be continuous or formed as discontinuous latching members disposed in spaced relationship about the periphery of base member 3230.

A circumferential groove 3270 is formed around the inside of closure cap or cover 3240 proximate a lower portion 3272 thereof so as to be disposed for co-action with rib or ribs 3260 so that closure cap may be permanently snapped in place over closure base 3230.

Ornamentation or decoration 3222 may be any kind and executed in any suitable medium. It may be formed in place as cover member 3220 is formed.

Figure 8:
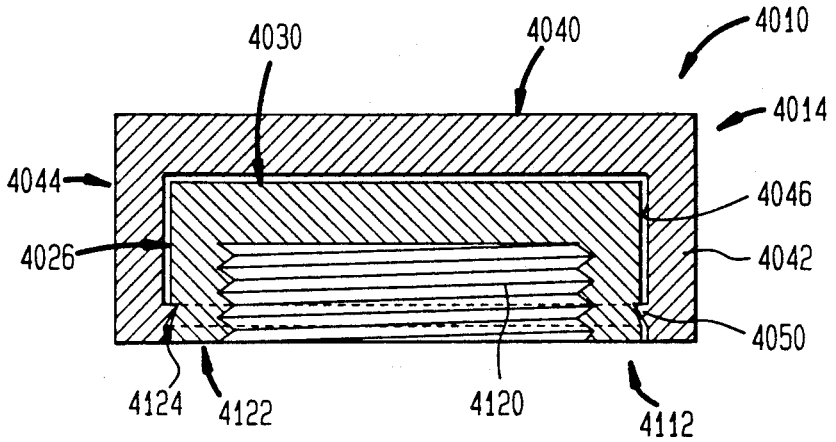
FIG. 8 is a vertical section through another alternative embodiment of closure assembly incorporating the instant invention and enlarged to better show details thereof.

FIG. 8 shows at 4010 an alternative closure assembly including a closure base member 4112 and a closure cap member 4014 all incorporating the instant invention. Closure base 4112 is fabricated from materials conventionally utilized to fabricate closures such as plastic, metal or the like and includes attachment structure 4120 generally in the form of internal screw threads suitably and conventionally formed within underside 4122 of closure base 4112. Attachment structure 4120 is of a size, configuration and disposition to receive and co-act with comparable attachment structure, such as external screw threads formed about a container which closure 4010 is to close. A groove 4124 is formed in a side surface 4026 of closure base 4112 and extends around the periphery and circumference of closure base 4112 at a predetermined location between underside 4122 and a top 4030 of closure base 4112. The circumferential configuration of closure base 4112 may be circular, oval, square or any other conventional configuration. If desired, groove 4124 may be discontinuous.

Closure cap member 4010 includes an upper surface 4040 and side wall 4042 including a side surface 4044 depending therefrom thus forming a cap-like member. Surfaces 4040 and 4044 may, if desired, be decorated with any desired motif, surface texture, color, or other aesthetic design or configuration. Side wall 4042 includes an inner surface 4046 having an open configuration corresponding to the circumferential configuration of said surface 4026 of closure base 4112. An outwardly extending rid 4050 extends about inner surface 4046 of side wall 4042 at a location thereon to co-act with groove 4124 of closure base 4112. Rib 4050 may be discontinuous or continuous and is formed discontinuous if groove 4124 is so formed and so as to correspond to and co-act with groove 4124.

At least side wall 4042 of closure cap member 4014 is formed to be resilient and so that it can snap over closure base 4112 so its rib 4050 will snap into and co-act with groove 4124 to secure closure cap member 4014 to closure base 4112. The resilience of side wall 4042 and the co-action of rib 4050 and groove 4124 is selected to permit relatively easy assembly of closure cap member 4014 and closure base member 4112 but not permit disassembly thereof.

The above described closure assembly construction thus also permits use of a single closure base member with many different closure cap members and facilitates the availability of a variety of closures to a manufacturer of articles which utilizes such closures while at the same time minimizing the number of items in inventory by reducing the number of closure bases for making such closure assemblies.

The size and configuration of member 4112 and its decorative portion 4014, would be selected to provide the size and configuration appropriate to the type and kind of closure. Attaching structure 4120 would be modified to the size and kind of container or the like to be used with the closure 4010.

Figure 9:
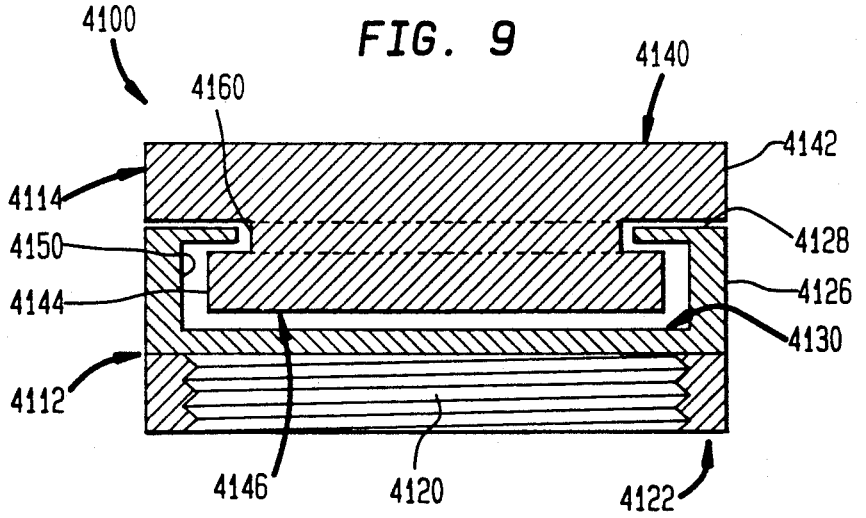
FIG. 9 is a vertical section through yet another alternative closure assembly construction incorporating the instant invention enlarged to better show details thereof.

FIG. 9 shows still another closure assembly 4100 including a closure base member 4112 and a closure cap member 4114 all incorporating the instant invention. Closure base member 4112, like closure base member 4112 of the FIG. 8 embodiment, is fabricated from materials conventionally utilized to fabricate closures and includes an attaching structure 4120 suitably and conventionally formed and extending into an underside 4122 of closure base member 4112. Attaching structure 4120 is of a size, configuration and disposition to be secured to a container to be closed by closure assembly 4100.

Closure base member 4112 is generally cup shaped and further includes an upwardly extending side wall 4126 about its periphery terminating in an in-turned lip or rib 4128 disposed at a predetermined height above a top surface 4130 of closure base member 4112. The circumferential configuration of closure base member 4112, like that of closure base 4112 of FIG. 8, may be circular, oval, square, rectangular or any other conventional configuration. If desired lip or rib 4128 may be discontinuous.

Closure cap member 4114 includes an upper surface 4140, upper side wall 4142, lower side wall 4144 and a lower surface 4146. Surface 4140 and the surface of upper side wall 4142 may, if desired, be decorated with any selected motif, surface texture, color, or other aesthetic design or configuration. The surfaces of lower side wall 4144, and if desired upper side wall 4142, are fabricated with a peripheral or circumferential configuration corresponding to that of side wall 4126 of closure base member 4114 with the peripheral configuration of lower side wall 4144 of reduced diameter to that of upper side wall 4142 and also corresponding to the internal peripheral configuration of lip 4128 and of an internal surface 4150 of side wall 4126 of closure base 4112. The height of lower side wall 4144 is such that lower surface 4146 of closure cap 4114 will not bottom against upper surface 4130 of closure base member 4112.

A circumferential groove 4160 extends around the periphery of closure cap member 4114 at the upper extremity of lower side wall 4144 thereof proximate upper side wall 4142. Groove 4160 may be continuous or discontinuous and if discontinuous along with lip 4128 is then groove will correspond to rib 4128 and co-act therewith as it will if groove 4160 is continuous.

At least side wall 4126 of closure base member 4112 is fabricated or formed to be resilient and so that its lip or rib 4128 will receiver and snap over lower side wall 4144 of closure cap 4114 and into groove 4160 to co-act therewith and secure closure cap member 4114 to closure base 4112.

The resilience of side wall 4126 of closure base member 4112 and the co-action of lip 4128 thereof with lower side wall 4144 and groove 4160 is selected to permit relatively easy assembly of closure cap member 4144 and closure base member 4112 but not permit disassembly thereof. Thus, the construction of the above described closure assembly 4100, like that of closure assembly 4010 of FIG. 8, permits use of a single closure base member with many different closure cap members and facilitates the availability of a variety of closures to a manufacturer of articles which utilizes such closures, while at the same time minimizing the number of items of inventory the manufacturer must stock by reducing the number of closure base members for making such closure assemblies.

The size and configuration of such base member and its decorative portion 4140 would be selected to provide the size and configuration appropriate to the type and kind of container to be closed by closure assembly 4100.

Figure 10:
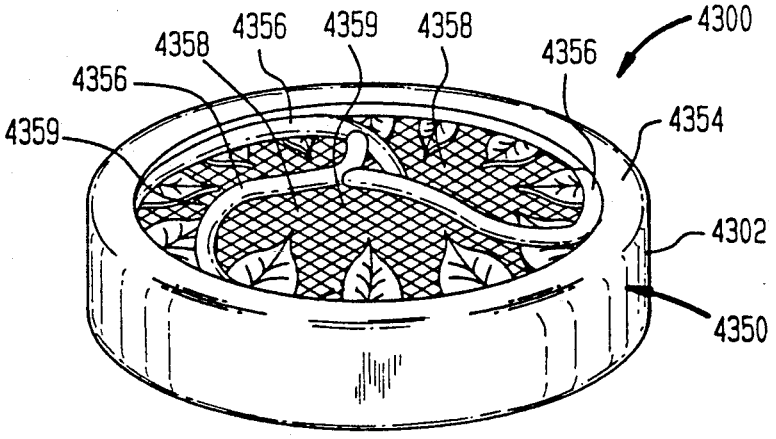
FIG. 10 is a perspective view of still another alternative closure assembly construction incorporating the instant invention and enlarged to better show details thereof.
Figure 11:
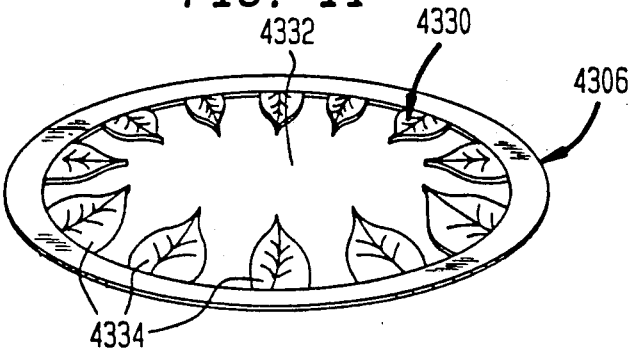
FIG. 11 is a perspective view of an intermediate member of the assembly of FIG. 10.
Figure 12:
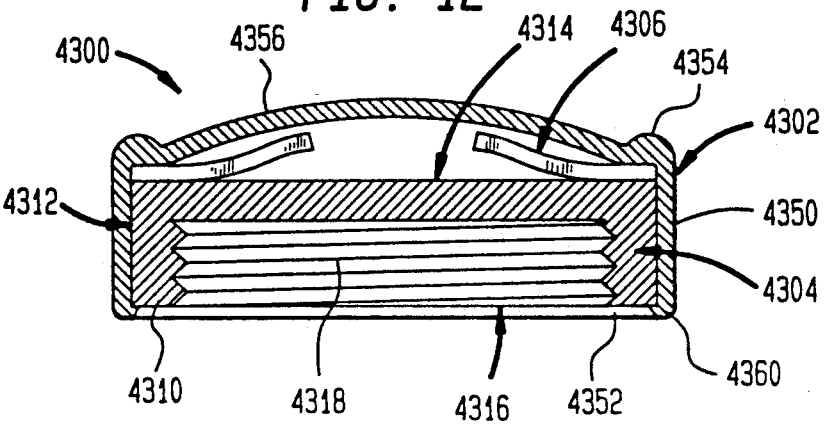
FIG. 12 is a vertical section through the assembly of FIG. 10.

FIGS. 10, 11 and 12 together show yet another embodiment of closure assembly 4300 (FIGS. 10 and 12) incorporating the instant invention. A closure cap member 4302 is formed to co-act with a closure base member 4304 and with an intermediate closure member 4306 (FIGS. 10–12) disposed therebetween as shown in FIGS. 10–12. Closure cap member 4302, base member 4304, and intermediate member 4306 may be fabricated from conventional and available materials usually employed for making closures as described for the hereinabove described closure assemblies with the material of closure cap member 4302 being resilient for purposes to be hereinafter described.

Closure base member 4304 includes a disc-like body 4310 (FIG. 12) having a side surface 4312, an upper surface 4314 and a lower surface 4316 within which threaded attaching structure 4318 is formed. At least upper surface 4314 of closure base member 4304 may be decorated like the selected surfaces of closure cap members 4014 and 4114 of the FIG. 8 and 9 embodiments, or if desired the entire body 4310 of base member 4304 may be covered by a fabric such as cloth, plastic, leather or the like.

Intermediate member 4306 is disc-like in that its peripheral configuration conforms to that of closure base member 4304 and closure cap member 4302. Intermediate member 4306 may be formed of relatively thin material dished upwardly as shown in FIGS. 11 and 12 and with a selected design 4330 cut therein and therethrough to form an opening 4332 and, if the design so employs, a number of lead-like elements 4334 disposed thereabout. Opening 4332 may be centrally and systematically located with leaf-like elements 4334 disposed symmetrically thereabout or they may be non-symmetrically disposed and not centered, as desired, as long as there is an opening through intermediate member 4306 through which upper surface 4314 of closure base member 4302 can be seen. Intermediate member 4306 also need not be dished as shown but may be just a relatively flat member.

Closure cap member 4302 includes a ring-like side wall 4350 having a lower opening 4352 (FIG. 12) at its bottom, a circumferential rib 4354 (FIGS. 10 and 12) around its top edge, and a plurality of lace-like strips 4356 spanning an upper opening 4358 dividing same into a plurality of smaller openings 4359. A bead-like rib 4360 (FIG. 12) extends about the circumferential periphery of lower opening 4352 for co-action with closure base member 4304 as will be hereinafter described. The height of side wall 4350 is selected so that bead 4360 thereof will snap beneath lower surface 4316 of closure base member 4304, when base member 4304 is disposed within cap member 4302 (as shown in FIG. 12) and when intermediate member 4306 is disposed on upper surface 4314 of base member 4302 (all as shown in FIG. 12) and co-act with lower surface 4316 of base member 4304 and side wall 4312 thereof to secure closure cap member 4302 and intermediate member 4306 together with closure base member 4304 to form closure assembly 4300. The resilience of at least side wall 4350 of closure cap member 4302 permits a relatively easy snapping of cap member 4302 over base member 4304 and intermediate member 4306 and thus assembly of closure 4300, but is not so resilient as to encourage or permit ready disassembly thereof.

Lace-like strips 4356 may be of any desired thickness, configuration, disposition and number and need not necessarily completely span upper opening 4358, as long as there are sufficient smaller openings 4359 to view intermediate member 4306 and closure base member 4302.

Closure assembly 4300 permits use of a single closure base member with many different intermediate and cap members to facilitate the availability of a large variety of closures as described for the closure assemblies of the previously described embodiments.

The size and configuration of base member 4304 and decorative portions 4302, 4306 would be selected to provide the size and configuration appropriate to the type and kind of closure. Attachment 4318 would be sized to accommodate the container.

Figure 13:
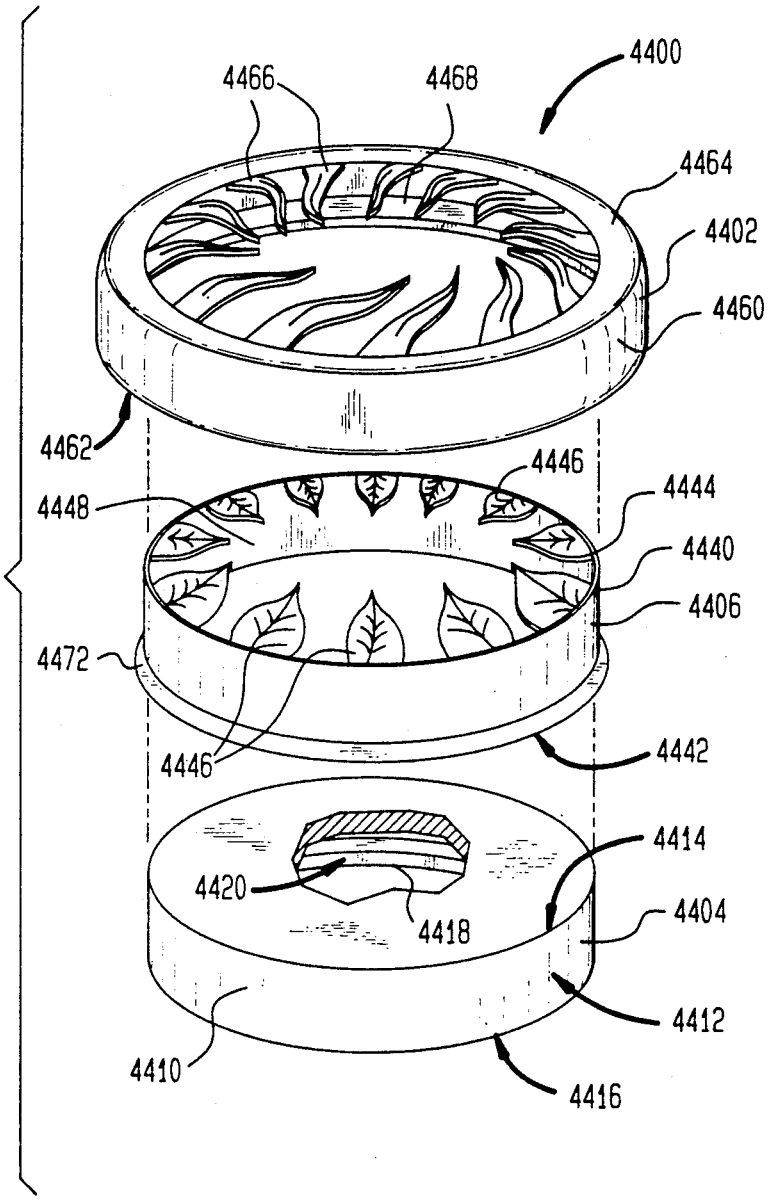
FIG. 13 is an exploded perspective view of yet still another alternative closure assembly construction incorporating the instant invention, enlarged to better show details thereof.
Figure 14:
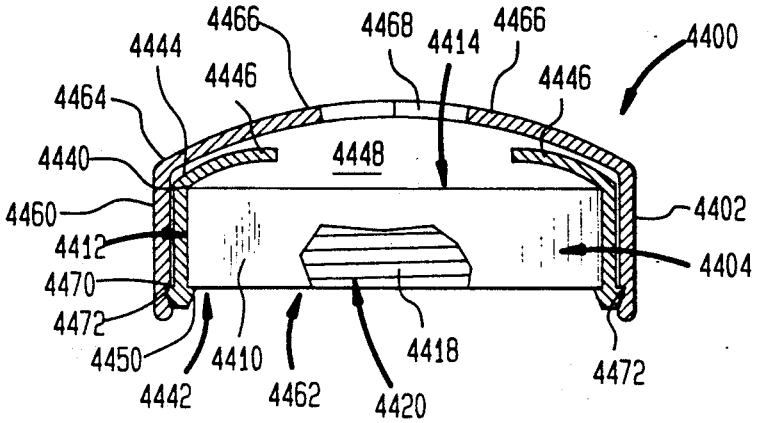
FIG. 14 is a vertical section through the assembled closure assembly construction of FIG. 13, further enlarged to better show details thereof.

FIGS. 13 and 14 together show still another embodiment of closure assembly 4400 incorporating the instant invention. A closure top-cap member 4402 is formed to co-act with a closure base member 4404 with a closure intermediate-cap member 4406 disposed therebetween. Top-cap member 4402, base member 4404 and intermediate-cap member 4406 may be fabricated from conventional materials usually employed for making closures as described for the other above described closure assemblies with the materials of closure top-cap member 4402 and intermediate-cap member 4406 being resilient for purposes to be hereinafter described.

Closure base member 4404 includes a disc-like body 4410 having a side surface 4412, an upper surface 4414 and a lower surface 4416 with which attaching structure 4418 is formed in space 4420 to receive and co-act with a container. At least upper surface 4414 of closure base member 4404 may be decorated like that of closure base member 4314 of closure assembly 4300 (FIGS. 10–12) or like closure base member 4304 closure base member 4404 may be covered by fabric such as cloth, plastic, leather or the like.

Closure top-cap member 4402 and closure intermediate-cap member 4406 are each cup-like and similar in configuration except that intermediate-cap member 4406 is of a size and configuration to snap over and co-act with closure base member 4404 and top-cap member 4402 is of a size and configuration to snap over and co-act with both intermediate-cap member 4406 and closure base member 4404.

Closure intermediate-cap member 4406 includes a ring-like side wall 4440 having a lower opening 4442 (FIG. 14) at its bottom, a circumferential rib 4444 around its top edge and a plurality of lead-like cut-out members 4446 extending into an upper opening 4448. A bead-like rib 4450 (FIG. 14) extends about the circumferential periphery of lower opening 4442 for co-action with closure base member 4404 as will be hereinafter described. The height of side wall 4440 is selected so that bead 4450 thereof will snap beneath lower surface 4416 of closure base member 4404, when closure base member 4404 is disposed within intermediate-cap member 4406 as shown in FIG. 14 and will co-act with lower surface 4416 and side wall 4412 of closure base member 4404 to secure intermediate-cap member 4406 in place.

Top-cap member 4402, like intermediate-cap member 4406, includes a ring-like side wall 4460 having a lower opening 4462 (FIG. 14) at its bottom, a circumferential rib 4464 around its top-edge and a plurality of leaf-like cut-out members 4466 extending into an upper opening 4468. A groove 4470 extends about the circumferential periphery of an inner surface of top-cap 4402 proximate lower opening 4462 for co-action with intermediate-cap member 4406 and closure base member 4404 as will be hereinafter described. The height of side wall 4460 is selected so that groove 4470 thereof will snap onto an outer bead 4472 proximate a lower edge of side wall 4440 of intermediate-cap member 4406, as shown in FIG. 14, when top-cap member 4402 is disposed over intermediate-cap member 4406 and will co-act with same to secure top-cap member 4402 in place.

Lead-like members 4446 of intermediate-cap member 4406 and 4466 of top-cap member 4402 may be of any desired thickness, configuration, disposition, and number and need not necessarily completely span their respective upper openings as long as there is sufficient open space through the tops of the cap members to view the intermediate-cap member leaf-like members through top-cap member 4402 and to view closure base member 4404 through both cap members. If desired, the leaf-like members 4446, 4466 of either or both cap members may be replaced by cross-ribs as utilized for top member 4302 of FIG. 10.

Closure assembly 4400 thus permits use of a single closure base with many different top-cap and intermediate-cap members to facilitate the availability of a large variety of closures as described for the closure assemblies of the previously described embodiments.

The size and configuration of such base member 4404 and its decorative portions 4402, 4406 would be selected to provide the size and configuration appropriate to the type and kind of container to be utilized.

Figure 15:
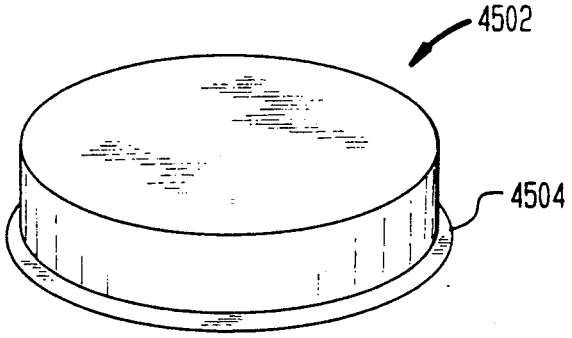
FIG. 15 is a perspective view of a further alternative closure assembly cap, incorporating the instant invention.
Figure 16:
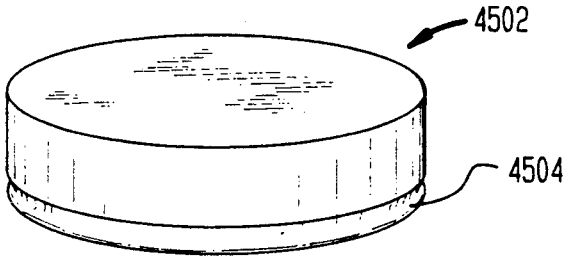
FIG. 16 is another perspective view of the closure cap of FIG. 15 with a manufacturing step performed thereon.
Figure 17:
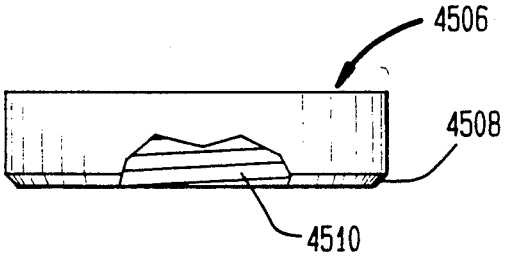
FIG. 17 is a side view of a closure base for the closure cap of FIGS. 15 and 16.

FIGS. 15–17 show yet another embodiment of closure in the configuration of a closure cap 4502. Cap 4502 may be made, for example, of metal, such as brass or aluminum. Fitted along a free marginal edge of cap 4502 may be a grommet or collar 4504. Collar 4504 may be made of any suitable material, such as rubber or plastic. Collar 4504 may be substantially ring-shaped and may have a slit cut circumferentially (not shown) to admit the marginal edge of the cap 4502.

In the next step, the edge of the cap 4502 is bent inwardly (as in FIG. 16). A closure base 4506 is of a similar construction to those disclosed hereinabove. A chamfer 4508 (FIG. 17) is formed at the lower or bottom portion of base 4506. Base 4506 has internal threads 4510. On assembly, cap 4502 is forced over base 4506 and collar 4504 snapped into chamfer 4508 locking cap 4502 into position.

The size and configuration of such base member 4506 and its decorative portion 4502, would be selected to provide the size and configuration appropriate to the type and kind of container to be utilized.

Figure 18:
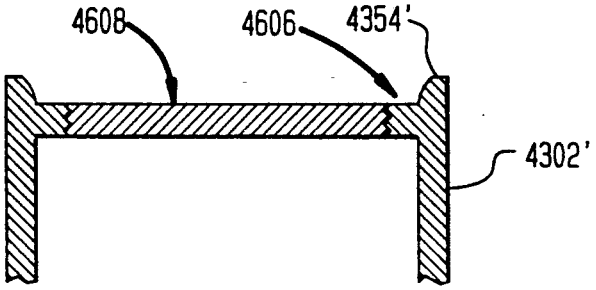
FIG. 18 is a sectioned view of yet another closure cap incorporating the instant invention.

It will also be understood that the cap (e.g., the cap of FIG. 11 or 13) may have a central portion internally threaded. Thus as shown in FIG. 18, a cap 4302' may have a threaded opening 4606 formed in its top wall adjacent to its circumferential portion 4354'. A design-bearing top wall 4608 may then be threaded into the top. Once threaded into position, the consumer will not be aware that the design is inserted into the closure.

This assembly enables the manufacturer to employ any of a multiplicity of design elements to be used with a single shaped cap and base.

While the various ribs 4050, 4128, 4360, 4450 and 4472 of the respective embodiments of FIGS. 8, 9, 10–12 and 13–14 respectively have been shown as being continuous about the circumference of their respective members, they may just as well be discontinuous as long as there is sufficient rib to co-act with the respective grooves or base members to provide the desired and required secure attachment of caps and bases.

With reference to FIG. 19 there is generally shown at 4610 a closure assembly including a closure base member 4612 and a closure cap member 4614 (FIGS. 19 and 20) all incorporating the instant invention. Closure base 4612 (FIG. 19) is fabricated from materials conventionally utilized to fabricate closures such as plastic, metal, wood, bone or the like and includes attaching structure 4620 (FIGS. 19 and 21) suitably and conventionally positioned at and extending into underside 4652 of closure base 4612. Attaching structure 4620 is of a size, configuration and disposition to receive and function with a suitable container or the like.

Closure cap member 4614 includes an upper surface 4640 and side wall 4642 depending therefrom thus forming a cap-like member. Surfaces 4640 may, if desired, be decorated with any desired motif, surface texture, color, or other aesthetic design or configuration. Side wall 4642 includes an inner surface 4646 (FIGS. 20 and 21) having an open configuration corresponding to the circumferential configuration of side surface 4648 (FIGS. 19 and 21) of closure base 4612. A plurality of inwardly extending ribs or latching elements 4650 extend about inner surface 4646 of side wall 4642 at locations thereon to co-act with bottom surface 4652 of closure base 4612. Latching elements 4650 are shown formed discontinuous and spaced about inner surface 4646 and so as to correspond to and co-act with bottom surface 4652 of closure base 4612.

At least side wall 4642 of closure cap member 4614 is formed to be resilient and so that it can snap over closure base 4612 so that latching elements will snap beneath and co-act with bottom surface 4652 of closure base 4612. The resilience of side wall 4642 and the co-action of latching elements 4650 with closure base 4612 is selected to permit relatively easy assembly of closure cap member 4614 and closure base member 4612 but not such as to encourage or permit ready disassembly thereof.

The above described closure assembly construction thus also permits use of a single closure base member with many different closure cap members and facilitates the availability of a variety of closures to a manufacturer which utilizes such closures, while at the same time minimizing the number of items in inventory by reducing the number of closure bases for making such closure assemblies.

Figure 22:
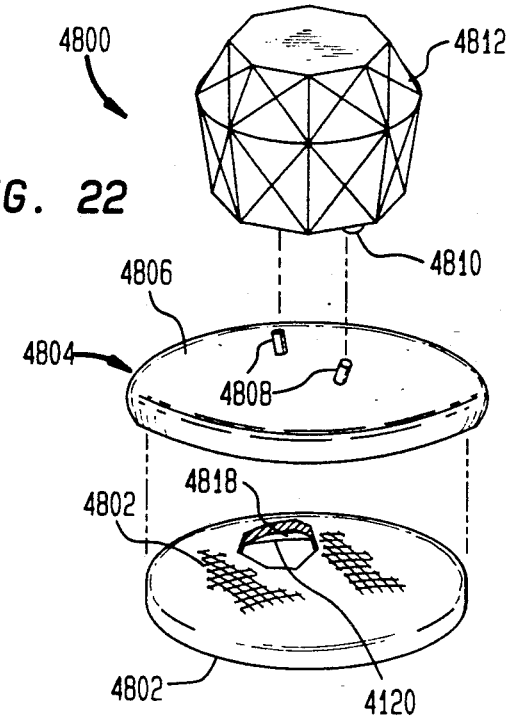
FIG. 22 is a schematic exploded showing of yet another alternative closure construction incorporating the instant invention.

FIG. 22 shows yet another embodiment of closure assembly 4800 incorporating the instant invention. A base member 4802 is formed of relatively plain and conventional material and into a configuration and size to receive and carry a cover member 4804 of a size and configuration to be received by and snap onto base member 4802 in a manner substantially identical to the co-action between the base and cap members of previously described embodiments. Cover member 4804 is formed from cloth covered or otherwise decorated and aesthetically pleasing ornamented material and so as receive on its surface 4806 a first half 4808 of a conventional snap type fastener the other half 4810 of which is carried by yet another element of ornamentation 4812. Ornamentation 4812 is smaller than cover member 4804 and snap type fastener halves 4804, 4810 are preferably disposed to position ornamentation element 4812 so as to be centered on cover member 4804. A non-centered disposition for ornamentation element 4812 on cover member 4804 may also be selected. A suitable threaded attaching structure 4818 is formed into inside wall 4120 of base member 4802 to secure closure assembly 4800 to a container.

Figure 23:
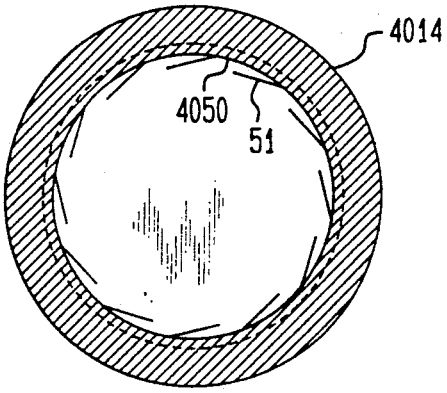
FIG. 23 shows a bottom cross-sectional view of another embodiment of the closure previously described in FIG. 8 showing catches which prevent closure cap rotation.

As heretofore described, the closure cap and closure base members, or combination closure cap and closure base with intermediate members are constructed in such a fashion that they are not removable from each other once assembled. Referring once again to FIG. 8 as one embodiment of this feature, once closure cap 4014 is pressed onto closure base 4112, rib 4050 slips into groove 4124. Rib 4050 and groove 4124 are fashioned so that they are not separable from one another. In one embodiment, the lower edge or rib 4050 may be rounded but the top edge may be flat so that it will not slip in an upward direction out of groove 4124. Alternatively, rib 4050 may hook into groove 4124 or into a channel within groove 4124. In another preferred embodiment, the groove of the closure base member, or the closure cap member as the case may be, may be provided with a series of stop catches to prevent rotation of the closure cap with respect to the closure base. FIG. 23 shows a bottom cross-sectional view of another embodiment of the cap 4014 previously described in FIG. 8. The cross section is made through rib 4050 which is provided with a series of fan-like projections 51 which catch the inside of groove 4124 and prevent rotation.

Figure 24:
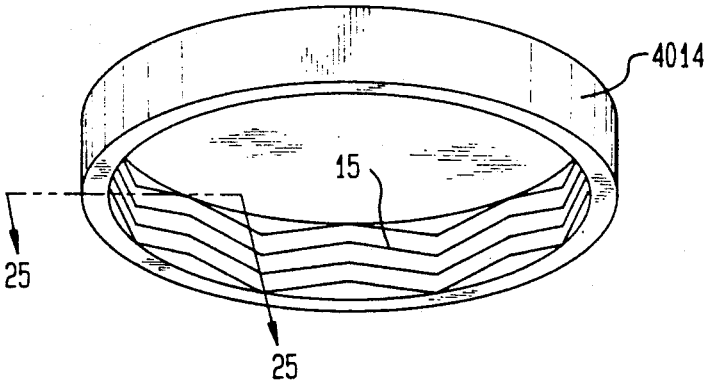
FIG. 24 shows a perspective view of another embodiment of the invention where the closure cap member is provided with chevron shaped catches for cooperation with a base member.
Figure 25:
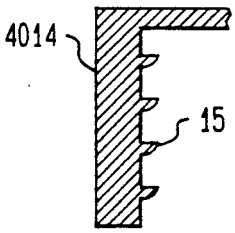
FIG. 25 shows a cross-sectional view of the closure cap member of FIG. 24.
Figure 26:
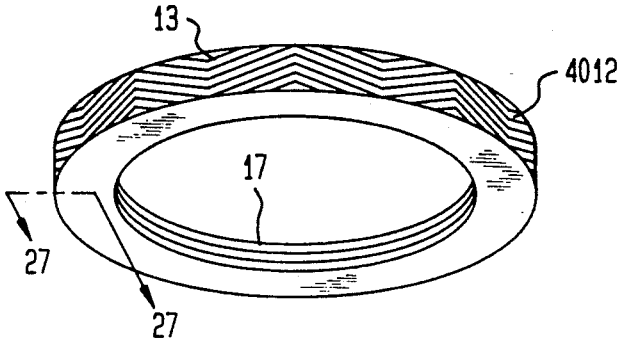
FIG. 26 shows a perspective view of another embodiment of the invention where the closure base member is provided with chevron shaped catches for cooperation with a closure cap member.
Figure 27:
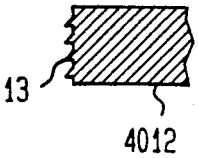
FIG. 27 shows a cross-sectional view of the closure base member of FIG. 26.

FIGS. 24–27 show another embodiment of the invention where closure cap member 4014 and closure base member 4012 are provided with complementary chevron members 13 and 15 respectively. Closure cap member 4014 is provided with several V-shaped recesses which snap together with V-shaped raised portions 13 on the closure base member. Alternatively, the V-shaped raised portions can be on the inside of the closure cap member 4014 and the recesses can be disposed on closure base 4012. When the closure cap and closure base of FIGS. 24 and 26 are snapped together in a manner analogous to that of FIG. 8, the complementary chevrons engage and the closure cap and closure base are non-removably, non-rotatably and non-movably attached. FIGS. 25 and 27 show cross-sectional views along lines 25—25 and 27—27 respectively of the chevron configured members of FIG. 24 and 26.

Figure 28:
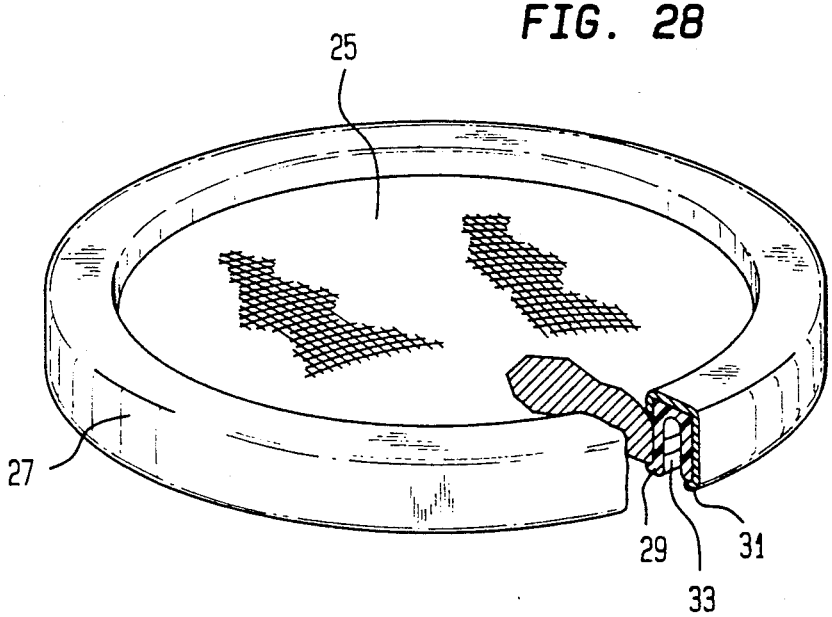
FIG. 28 shows a perspective view of another embodiment of a closure cap member.

FIG. 28 shows another embodiment of the invention wherein a closure cap member 25 is provided with a circumferential metal ring 27 around its outer periphery. Inside the ring is a plastic retainer 29. The retainer is held in place by a crimped over edge 31 of the metal ring. Inside of the retainer 29 is annular channel 33 which has either groove or rib means as previously described for cooperation with the complementary closure base means. Similarly, this ring and retainer could be provided on the closure base for cooperation and engagement with complementary closure cap.

From the above description it will thus be seen that there has been provided new and novel closure assemblies which are constructed from bases, caps and intermediate members which snap together in selected combination to provide a large and wide variety of closures and closure assemblies from a small number of individual members in a simple and efficient manner.

It is understood that although I have shown the preferred forms of my invention that various modifications may be made in the details thereof without departing from the spirit as comprehended from the following claims.

What is claimed is:

1. A closure assembly comprising:

(a) closure base means including threaded attaching means capable of securing said closure base means to a bottle article; and (b) closure cap means for co-action with and mounting to said closure base means; and (c) said closure base means and said closure cap means together carrying securing means for non-removably securing said closure base means and closure cap means together into a closure assembly, said securing means including securing elements which readily co-act to secure said closure base means and closure cap means together and which substantially prevent separation of said closure base means and said closure cap means wherein said securing elements comprise at least one raised chevron shaped wedge member positioned about one of an internal and external perimeter wall of one of said cap means and said base means, and oppositely, at least one complementary recessed chevron shaped wedge member positioned about one of an external and internal perimeter wall of one of said base means and said cap means, whichever does not have the raised chevron members, said raised chevron members and said recessed chevron members being capable of a snap-together engagement with one another, which engagement substantially prevents movement of said cap means with respect to said base means.

2. The closure assembly of claim 1, wherein said closure cap means is decorated.

3. The closure assembly of claim 1, wherein said closure base means and said closure cap means each have a circular peripheral configuration.

4. The closure assembly of claim 1 comprising a plurality of raised and recessed chevron shaped wedge members positioned about said perimeter walls of said closure base means and said closure cap means.

5. The closure assembly of claim 4 comprising a plurality of raised and recessed chevron shaped wedge members disposed in a plurality of bands positioned about said perimeter walls of each of said closure base means and said closure cap means.

6. The closure assembly of claim 1 wherein the attaching means for securing said closure base means to a bottle or the like comprises screw thread means on said closure base means.

7. A method of producing a closure assembly comprising:

(a) providing closure base means including threaded means capable of attaching said closure base means to a bottle article; and (b) providing closure cap means for co-action with and mounting to said closure base means; and (c) said closure base means and said closure cap means together carrying securing means for non-removably securing said closure base means and closure cap means together into an assembly, said securing means including securing elements which readily co-act to secure said closure base means and closure cap means together and which prevent separation of said closure base means and said closure cap means; said securing elements comprise at least one raised chevron shaped wedge member positioned about one of an internal and external perimeter wall of one of said closure cap means and said closure base means, and oppositely, at least one complementary recessed chevron shaped wedge member positioned about one of an external and internal perimeter wall of one of said closure base means and said closure cap means, whichever does not have the raised chevron members, said raised chevron members and said recessed chevron members being capable of a snap-together engagement with one another, which engagement substantially prevents movement of said closure cap means with respect to said closure base means; and d) snapping together said closure base means and said closure cap means and engaging said complementary recessed and raised chevron members.

* * * * *